US006299416B1

(12) United States Patent
Kwag

(10) Patent No.: US 6,299,416 B1
(45) Date of Patent: Oct. 9, 2001

(54) BULK MATERIAL PUMP DEVICE

(75) Inventor: Pil Gyou Kwag, Euiwang-si (KR)

(73) Assignee: Daewoo Heavy Industries Ltd., Incheon (KR)

( * ) Notice: Subject to any disclaimer, the term of this patent is extended or adjusted under 35 U.S.C. 154(b) by 0 days.

(21) Appl. No.: 09/414,540

(22) Filed: Oct. 8, 1999

(30) Foreign Application Priority Data

Oct. 10, 1998 (KR) ..... 98-42395

(51) Int. Cl.[7] ..... F04B 17/00; F04B 35/00
(52) U.S. Cl. ..... 417/403; 417/342
(58) Field of Search ..... 417/53, 313, 317, 417/102, 403, 63, 345, 234, 342, 273, 280; 118/680

(56) References Cited

U.S. PATENT DOCUMENTS 3,918,849 * 11/1975 Schurenberg ..... 417/313
4,105,373 * 8/1978 Calzolari ..... 417/317
4,229,143 * 10/1980 Pucher et al. ..... 417/53
4,304,527 * 12/1981 Jewell et al. ..... 417/102
4,391,571 * 7/1983 Craggs ..... 417/403
4,490,096 * 12/1984 Box ..... 417/342
4,519,753 * 5/1985 Kitsnik ..... 417/403
4,545,736 * 10/1985 Walton ..... 417/63
4,701,112 * 10/1987 Eisenhut et al. ..... 417/345
4,718,826 * 1/1988 Simmer ..... 417/234
4,913,089 * 4/1990 Atkins et al. ..... 118/680
4,915,595 * 4/1990 Nelson et al. ..... 417/273
5,213,478 * 5/1993 Hoya ..... 417/53
5,330,327 * 7/1994 Anderson ..... 417/53
5,520,521 * 5/1996 Benckert et al. ..... 417/280
6,116,865 * 9/2000 Fischer et al. ..... 417/403

* cited by examiner

*Primary Examiner*—Teresa Walberg
*Assistant Examiner*—Leonid M Fastovsky
(74) *Attorney, Agent, or Firm*—Staas & Halsey, LLP

(57) ABSTRACT

A bulk material pump device includes first and second hydraulic drive cylinders capable of causing alternate reciprocating movement of the corresponding pumping pistons to pump concrete contained in a hopper through a transportation conduit. The first drive cylinder has a cylinder housing whose bore is divided into a base chamber and a head chamber by a drive piston slidably received in the cylinder housing. The base chamber is in fluid communication with an oil pump while the head chamber is connected to the second drive cylinder. Under a loaded operation condition, a part of the pressurized oil in the base chamber is admitted into the head chamber via a head bypass line at the end of retracting movement of the drive piston and almost the same amount of the oil is returned back from the head chamber to the base chamber via a base bypass line at the end of extending movement thereof. Under an idle operation condition, the oil admitted into the head chamber is not returned back to the base chamber but, instead, will be drained to an oil tank by the action of a solenoid valve and a cartridge valve provided along a drain line.

5 Claims, 7 Drawing Sheets

BULK MATERIAL PUMP DEVICE

FIELD OF THE INVENTION

The instant invention pertains generally to a hydraulically operated bulk material pump device and, more specifically, to a hydraulic pump device built in a typical concrete pump truck such that, when operated, it can forcedly feed fluidized concrete through an elongated transportation conduit up to a remote pouring location within a construction site.

BACKGROUND OF THE INVENTION

There are two kinds of generally known methods of pumping bulk material through a pipeline which leads to a remote pouring position. One is a screw pumping method whereby bulk material can be pumped into a transportation conduit by means of a motor-driven feeder screw or auger. This method has been extensively used in pumping a uniform amount of low viscosity bulk material with reduced pulsation but has a drawback in that it is unsuitable for use in high-pressure, long-distance pumping of the bulk material because the drive motor cannot endure severe overload condition encountered.

The other method of pumping bulk material is to use a pair of hydraulic drive cylinders which are designed to cause alternate reciprocating movement of dual pump cylinders to thereby force the bulk material into a transportation pipeline. The drive cylinder type pumping method can be advantageously utilized in high-pressure, long-distance transportation of high density and high viscosity bulk material such as concrete, mortar and industrial wastes, although it tends to produce a great deal of vibration and pulsation in the pumping process.

With reference to FIGS. 1 through 3, there is illustrated a prior art drive cylinder type concrete pump device widely employed in a typical concrete pump truck. The concrete pump device has a reversible oil pump 10 which can discharge a variable volume of pressurized oil, and first and second hydraulic drive cylinders 12, 14 each of which remains in fluid communication with the oil pump 10. The first drive cylinder 12 consists of a cylinder housing 16 with an axial bore 18 and a drive piston 20 with a piston rod 22 slidably fitted into the cylinder housing 16 to divide the axial bore 18 of the cylinder housing 16 into a base chamber 24 and a head chamber 26. The volume of the base and head chambers 24, 26 varies with the position of the drive piston 20 in such a manner that, if the volume of the base chamber 24 becomes greater, that of the head chamber 26 gets smaller in proportion thereto and vice versa. The base chamber 24 is connected to the oil pump 10 via a first fluid line 28 which serves both as a supply line and a return line depending on the direction of rotation of the oil pump 10.

The second drive cylinder 14 consists of a cylinder housing 30 with an axial bore 32 and a drive piston 34 with a piston rod 36 slidably received in the cylinder housing 30 to divide the axial bore 32 of the cylinder housing 30 into a base chamber 38 and a head chamber 40. As with the first drive cylinder 12 set forth above, the volume of the base and head chambers 38, 40 in the second drive cylinder 14 varies with the position of the drive piston 34 in such a manner that the volume of the head chamber 40 becomes smaller in proportion to the increase of the volume of the base chamber 38 and vice versa. The base chamber 38 is coupled to the oil pump 10 by way of a second fluid line 42 which functions both as a supply line and a return line. The head chamber 40 of the cylinder housing 30 of the second drive cylinder 14 is in fluid communication with the head chamber 26 of the cylinder housing 16 of the first drive cylinder 12 via an intermediate fluid line 44.

The concrete pump device further includes first and second pump cylinders 46, 48 operatively connected to the first and second hydraulic drive cylinders 12, 14. The first pump cylinder 46 has a pumping barrel 50 with an open front end and a pumping piston 52 slidably received in the pumping barrel 50. The pumping piston 52 is affixed to the piston rod 22 of the first drive cylinder 12 so that it can be subjected to reciprocating movement together with the drive piston 20 of the first drive cylinder 12, thus pumping the concrete contained in a hopper 54. The second pump cylinder 48 has a pumping barrel 56 with an open front end and a pumping piston 58 slidably fitted through the pumping barrel 56. The pumping piston 58 of the second pump cylinder 48 is secured to the piston rod 36 of the second drive cylinder 14, meaning that the pumping piston 58 can move together with the drive piston 34 of the second drive cylinder 14 to thereby pump the concrete contained in the hopper 54. A transportation conduit 60 is alternately coupled to the respective one of the pumping barrels 50, 56 just prior to the extending movement of the pumping pistons 52, 58, thus receiving the concrete pumped by the first and second pump cylinders 46, 48. Alternate coupling of the transportation conduit 60 to the first and second pump cylinders 46, 48 is performed by a hydraulic switching actuator not shown in the drawings.

It will be noted that a head bypass line 62 is provided at the head portion of the cylinder housing 16 to allow fluid introduction from the base chamber 24 into the head chamber 26 when the drive piston 20 of the first drive cylinder 12 is at the end of retracting movement as indicated in a phantom line in FIG. 1. Such fluid introduction through the head bypass line 62 helps increase the pressure in the head chamber, thus swiftly reducing the retracting speed of the drive piston 20 and hence avoiding any crash of the piston 20 against the head cover of the cylinder housing 16. Backflow of fluid through the head bypass line 62 is inhibited by a check valve 64 even though the pressure in the head chamber 26 becomes higher than the pressure in the base chamber 24 at the beginning of extending movement of the drive piston 20.

Provided at the base portion of the cylinder housing 16 of the first drive cylinder 12 is a base bypass line 66 which permits fluid introduction from the head chamber 26 into the base chamber 24 when the drive piston 20 of the first drive cylinder 12 is at the end of extending movement as illustrated in a solid line in FIG. 1. Such fluid introduction into the base chamber 24 through the base bypass line 66 helps increase the pressure in the base chamber 24, thereby quickly decreasing the extending speed of the drive piston 20 and hence avoiding any crash of the piston 20 against the base cover of the cylinder housing 16. Backflow of fluid through the base bypass line 66 is prohibited by a check valve 68 even though the pressure in the base chamber 24 grows higher than the pressure in the head chamber 26 at the beginning of retracting movement of the drive piston 20.

Likewise, a base bypass line 70 is provided at the base portion of the cylinder housing 30 of the second drive cylinder 14. The base bypass line 70 allows fluid introduction from the head chamber 40 into the base chamber 38 when the drive piston 34 of the second drive cylinder 14 is at the end of extending movement as shown in a phantom line in FIG. 1. Such fluid introduction through the base bypass line 70 helps increase the pressure in the base chamber 38 to thereby reduce the extending speed of the drive piston 34 for avoidance of its crash against the base cover of the cylinder housing 30. Backflow of fluid through the base bypass line 70 is prevented by a check valve 72 even though the pressure in the base chamber 38 becomes greater than the pressure in the head chamber 40 at the beginning of retracting movement of the drive piston 34 of the second drive cylinder 14.

A retraction sensor 74 and an extension sensor 76 are placed respectively at the head portion and the base portion of the cylinder housing 30 of the second drive cylinder 14. The retraction sensor 74 is adapted to issue a piston retraction signal as the drive piston 34 moves past the retraction sensor 74 at the end of retracting movement thereof. Similarly, the extension sensor 76 serves to generate a piston extension signal as the drive piston 34 moves past the extension sensor 76 at the end of extending movement. The piston retraction signal and the piston extension signal so produced are fed to a pump controller 78 which in turn will change the direction of rotation of the oil pump 10 each time one of the piston retraction and extension signals are received. This enables the drive piston 20 of the first drive cylinder 12 and the drive piston 34 of the second drive cylinder 14 to move in the reverse direction, causing alternate reciprocating movement of the pumping pistons 52, 58 of the first and second pump cylinders 46, 48'.

According to the prior art concrete pump device explained above by way of example, if the oil pump 10 feeds pressurized oil through the first fluid line 28, the drive piston 20 of the first drive cylinder 12 will be retracted together with the pumping piston 52 to suck in the concrete from the hopper 54 and, at the same time, the drive piston 34 of the second drive cylinder 14 will be extended together with the pumping piston 58 to discharge the concrete into the transportation conduit 60. During the course of such a "loaded" operation, the oil pressure will be greatest in the base chamber 24, medium level in the head chambers 26, 40 and lowest in the base chamber 38. Thus the oil in the base chamber 24 will be admitted into the head chamber 26 through the head bypass line 62 at the end of the retracting movement of the drive piston 20 to thereby suppress further retracting movement thereof, while the oil in the head chamber 40 of the second drive cylinder 14 will be introduced into the base chamber 38 via the base bypass line 70 at the end of extending movement of the drive piston 34 to thereby retard further extending movement of the latter.

In the event that the oil pump 10 is rotated in the reverse direction to feed pressurized oil through the second fluid line 42 to cause retracting movement of the drive piston 34 and extending movement of the drive piston 20, the oil pressure will be greatest in the base chamber 38, medium level in the head chambers 40, 26 and smallest in the base chamber 24. As a result, the oil in the head chamber 26 will be admitted into the base chamber 24 through the base bypass line 66 at the end of extending movement of the drive piston 20 to thereby retard further extending movement of the latter. It can be seen from the foregoing that, in the course of loaded operation of the concrete pump device, almost the same amount of the oil introduced into the head chamber 26 through the head bypass line 62 at the end of retracting movement of the drive piston 20 is returned back to the base chamber 24 through the base bypass line 66 at the end of extending movement of the drive piston 20. This means that no surplus oil is accumulated in the head chamber 26 during the loaded operation of the concrete pump device.

Such is not the case in case of load-free idle operation of the concrete pump device with the hopper 54 being empty. Specifically, if the pressurized oil is fed through the first fluid line 28 to cause retracting movement of the drive piston 20 of the first drive cylinder 12, as shown in FIG. 2, the oil pressure(typically 26 bar) in the head chambers 26, 40 is kept lower than the oil pressure(35 bar) in the base chamber 38 of the second drive cylinder 14 as well as the oil pressure(45 bar) in the base chamber 24 of the first drive cylinder 12. Accordingly, the oil in the base chamber 24 will be introduced into the head chamber 26 through the head bypass line 62 at the end of rightward, retracting movement of the drive piston 20, as in the loaded operation described above.

However, the oil pressure in the base chamber 24 will not drop to below the pressure in the head chamber 26 during the extending movement of the drive piston 20 under the load-free, idle operation condition, as shown in FIG. 3. This means that the oil introduced into the head chamber 26 through the head bypass line 62 during the end of the extending movement cannot be returned back to the base chamber 24 even at the end of the leftward, extending movement of the drive piston 20 and therefore will be accumulated in the head chamber 26. Each time the drive piston 20 is subjected to one cycle of reciprocating movement, therefore, the stroke of the drive piston 20 is shifted toward the base cover of the cylinder housing 16 by the displacement "$\chi$" (see FIG. 3) which corresponds to the amount of the oil introduced into the head chamber 26 during the retracting movement of the drive piston 20. Repeated reciprocating movement of the drive piston 20 in this manner under the idle operation condition will result in gradual increase of the stroke shifting amount, eventually causing the drive piston 20 to make crash against the base cover of the cylinder housing 16. Such crash is a major culprit in producing noise and adversely affect the structural integrity of the concrete pump device, which may lead to damage and shortened service life of key parts of the concrete pump device.

SUMMARY OF THE INVENTION

Accordingly, it is an object of the present invention to provide a bulk material pump device which can prevent any unwanted shift of stroke of a drive piston during the idle operation of the bulk material pump device, thus avoiding an otherwise occurring crash of the drive piston against a cylinder housing to assure prolonged service lift of the device.

With this object in view, the invention provides a bulk material pump device, comprising: an oil tank; an oil pump for producing pressurized oil; first and second hydraulic drive cylinders each having a cylinder housing with an axial bore and a drive piston with a piston rod, the drive piston slidably received in the axial bore to divide it into a base chamber and a head chamber, the base chamber of the first drive cylinder connected to the oil pump via a first fluid line, the base chamber of the second drive cylinder coupled to the oil pump via a second fluid line, the head chamber of the first drive cylinder being in fluid communication with the head chamber of the second drive cylinder, the cylinder housing of the first drive cylinder having a head bypass line adapted to connect the base chamber and the head chamber together at the end of retracting movement of the drive piston of the first drive cylinder and a base bypass line adapted to couple the base chamber and the head chamber together at the end of extending movement of the drive piston of the first drive cylinder, the bore of the cylinder housing of the first drive cylinder leading to the oil tank via a drain line; first and second pump cylinders each having a pumping barrel and a pumping piston slidably received in the pumping barrel, the pumping piston of the first pump cylinder affixed to the piston rod of the first drive cylinder for unitary movement therewith, the pumping piston of the second pump cylinder attached to the piston rod of the second drive cylinder for unitary movement therewith; and a solenoid valve provided on the drain line and having a spool shiftable between a closed position and an open position, the spool of the solenoid valve normally biased into the closed position to block the drain line and shiftable into the open position when the solenoid valve is energized, to permit oil drainage therethrough.

BRIEF DESCRIPTION OF THE DRAWINGS

Other objects, features and advantages of the invention will become apparent from the following description of the preferred embodiment taken in conjunction with the accompanying drawings in which.

DETAILED DESCRIPTION OF THE PREFERRED EMBODIMENT

Figure 1:
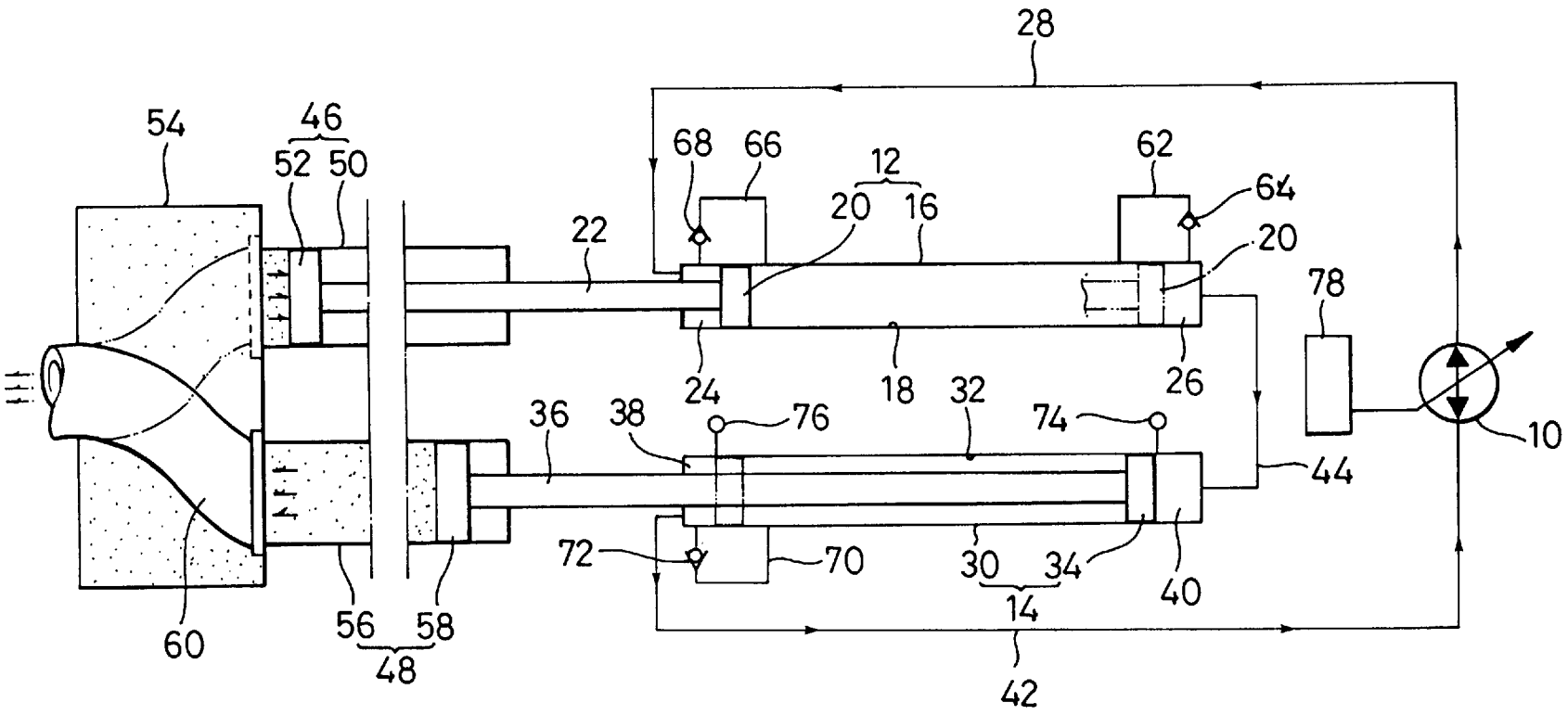
FIG. 1 PRIOR ART
FIG. 1 is a schematic diagram showing a prior art concrete pump device which employs first and second hydraulic drive cylinders adapted for alternate reciprocating movement by the pressurized oil supplied from an oil pump.
Figure 2:
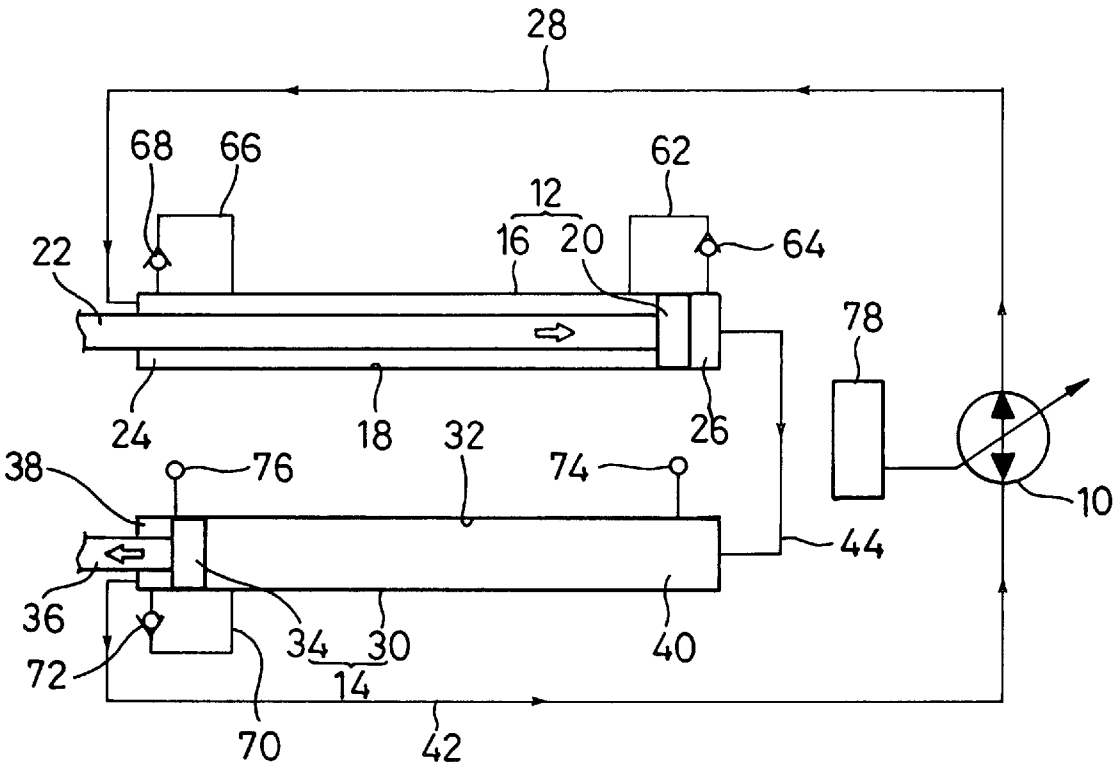
FIG. 2 PRIOR ART
FIG. 2 is a partially cut away view of the prior art concrete pump device wherein the piston of the first drive cylinder is at the end of retracting movement under an idle operation condition, with the piston of the second drive cylinder being at the end of extending movement.
Figure 3:
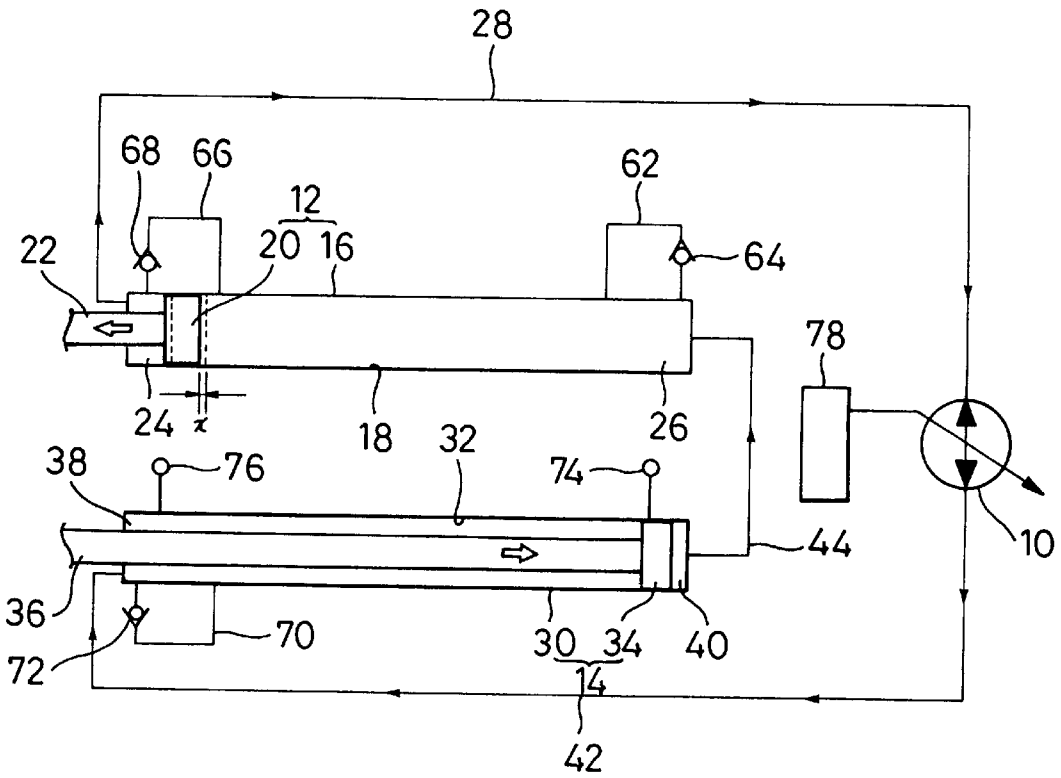
FIG. 3 PRIOR ART
FIG. 3 is a view similar to FIG. 2 but showing the prior art concrete pump device wherein the piston of the first drive cylinder is at the end of extending movement, with the piston of the second drive cylinder being at the end of retracting movement under the idle operation condition.
Figure 4:
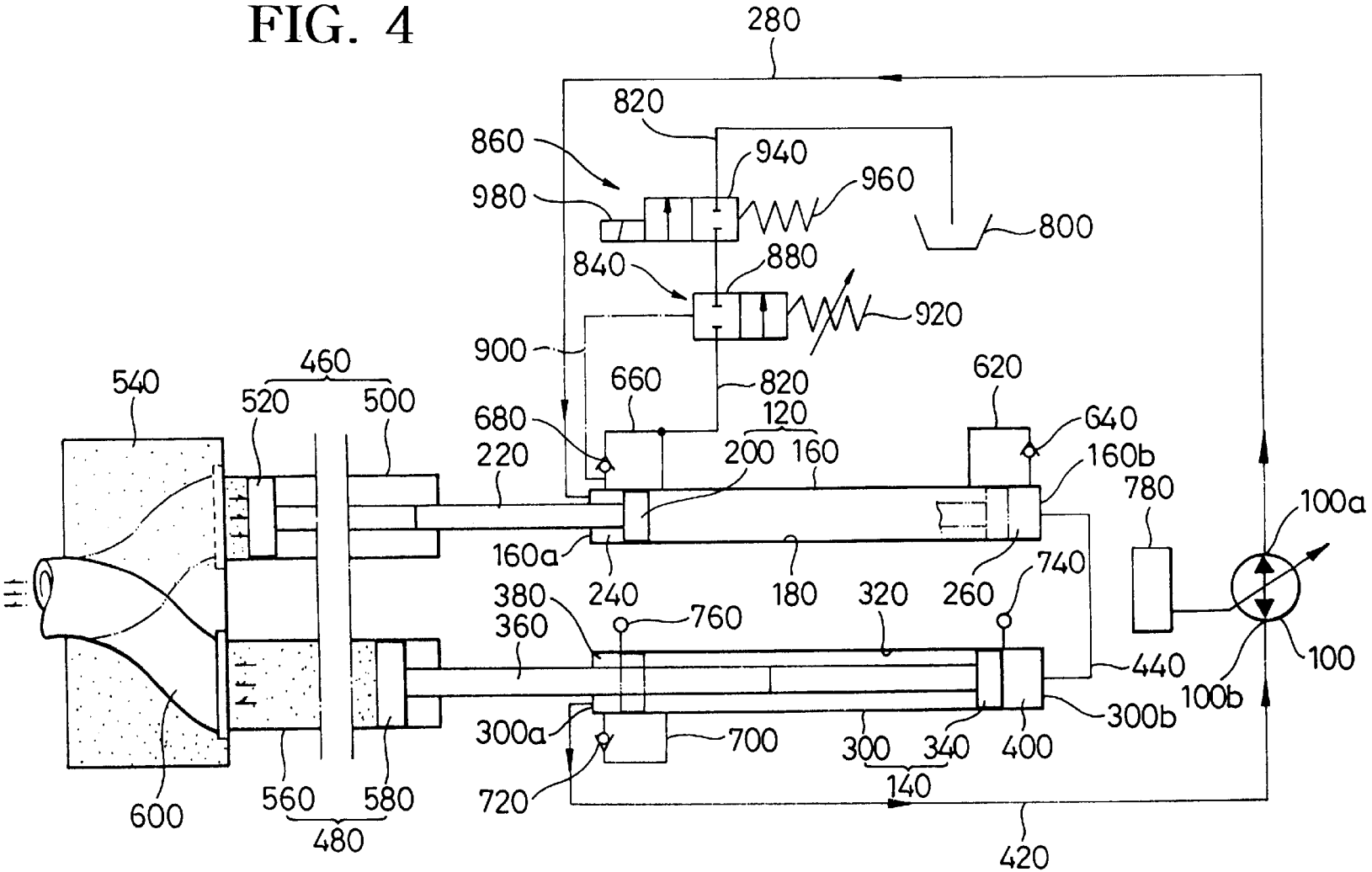
FIG. 4 shows a concrete pump device in accordance with the invention wherein the drive piston of a first drive cylinder is at the beginning of retracting movement and the drive piston of a second drive cylinder is at the beginning of extending movement.

Referring now to FIG. 4, it will be appreciated that there is shown a hydraulically operated concrete pump device, usually built in a concrete pump truck, as an example of a bulk material pump device in accordance with the invention. The concrete pump device has a reversible oil pump 100 which can discharge a variable volume of pressurized oil through a first port 100*a* or a second port 100*b*, and first and second hydraulic drive cylinders 120, 140 each of which remains in fluid communication with the oil pump 100. The first drive cylinder 120 consists of a cylinder housing 160 with an axial bore 180 and a drive piston 200 with a piston rod 220 slidably fitted into the cylinder housing 160 to divide the axial bore 180 of the cylinder housing 160 into a base chamber 240 and a head chamber 260. The cylinder housing 160 of the first drive cylinder 120 is provided with a base cover 160*a* and a head cover 160*b* at the opposite ends thereof. The volume of the base and head chambers 240, 260 varies with the position of the drive piston 200 in such a manner that, if the volume of the base chamber 240 becomes greater, that of the head chamber 260 gets smaller in proportion thereto and vice versa. The base chamber 240 is connected to the oil pump 100 via a first fluid line 280 which serves both as a supply line and a return line depending on the direction of rotation of the oil pump 100.

The second drive cylinder 140 consists of a cylinder housing 300 with an axial bore 320 and a drive piston 340 with a piston rod 360 slidably received in the cylinder housing 300 to divide the axial bore 320 of the cylinder housing 300 into a base chamber 380 and a head chamber 400. The cylinder housing 300 of the second drive cylinder 140 is provided with a base cover 300*a* and a head cover 300*b* at the opposite ends thereof As with the first drive cylinder 120 set forth above, the volume of the base and head chambers 380, 400 in the second drive cylinder 140 varies with the position of the drive piston 340 in such a manner that the volume of the head chamber 400 becomes smaller in proportion to the increase of the volume of the base chamber 380 and vice versa. The base chamber 380 is coupled to the oil pump 100 by way of a second fluid line 420 which functions both as a supply line and a return line. The head chamber 400 of the cylinder housing 300 of the second drive cylinder 140 is in fluid communication with the head chamber 260 of the cylinder housing 160 of the first drive cylinder 120 via an intermediate fluid line 440.

As clearly shown in FIG. 4, the concrete pump device further includes first and second pump cylinders 460, 480 operatively connected to the first and second hydraulic drive cylinders 120, 140, The first pump cylinder 460 has a pumping barrel 500 with an open front end and a pumping piston 520 slidably received in the pumping barrel 500. The pumping piston 520 is affixed to the piston rod 220 of the first drive cylinder 120 so that it can be subjected to reciprocating movement together with the drive piston 200 of the first drive cylinder 120, thus pumping the concrete contained in a hopper 540. The second pump cylinder 480 has a pumping barrel 560 with an open front end and a pumping piston 580 slidably fitted through the pumping barrel 560. The pumping piston 580 of the second pump cylinder 480 is secured to the piston rod 360 of the second drive cylinder 140, meaning that the pumping piston 580 can move together with the drive piston 340 of the second drive cylinder 140 to thereby pump the concrete contained in the hopper 540. A transportation conduit 600 is alternately coupled to the respective one of the pumping barrels 500, 560 just prior to the extending movement of the corresponding pumping pistons 520, 580, thus receiving and conveying the concrete pumped by the first and second pump cylinders 460, 480. Alternate coupling of the transportation conduit 600 to the first and second pump cylinders 460, 480 is performed by a hydraulic switching actuator not shown in the drawings for the sake of simplicity.

It will be noted that a head bypass line 620 is provided at the head portion of the cylinder housing 160 to allow fluid introduction from the base chamber 240 into the head chamber 260 when the drive piston 200 of the first drive cylinder 120 is at the end of retracting(rightward) movement as indicated in a phantom line in FIG. 4. Such fluid introduction through the head bypass line 620 helps increase the pressure in the head chamber, thus swiftly reducing the retracting speed of the drive piston 200 and hence avoiding any crash of the piston 200 against the head cover 160*b* of the cylinder housing 160. Backflow of fluid through the head bypass line 620 is inhibited by a check valve 640 even though the pressure in the head chamber 260 becomes higher than the pressure in the base chamber 240 at the beginning of extending(leftward) movement of the drive piston 200.

Provided at the base portion of the cylinder housing 160 of the first drive cylinder 120 is a base bypass line 660 which permits fluid introduction from the head chamber 260 into the base chamber 240 when the drive piston 200 of the first drive cylinder 120 is at the end of extending movement as illustrated in a solid line in FIG. 4. Such fluid introduction into the base chamber 240 through the base bypass line 660 helps increase the pressure in the base chamber 240, thereby quickly decreasing the extending speed of the drive piston 200 and hence avoiding any crash of the piston 200 against the base cover 160a of the cylinder housing 160. Backflow of fluid through the base bypass line 660 is prohibited by a check valve 680 even though the pressure in the base chamber 240 grows higher than the pressure in the head chamber 260 at the beginning of retracting movement of the drive piston 200.

Likewise, a base bypass line 700 is provided at the base portion of the cylinder housing 300 of the second drive cylinder 140. The base bypass line 700 allows fluid introduction from the head chamber 400 into the base chamber 380 when the drive piston 340 of the second drive cylinder 140 is at the end of extending(leftward) movement as shown in a phantom line in FIG. 4. Such fluid introduction through the base bypass line 700 helps increase the pressure in the base chamber 380 to thereby reduce the extending speed of the drive piston 340 for avoidance of its crash against the base cover 300*a* of the cylinder housing 300. Backflow of fluid through the base bypass line 700 is prevented by a check valve 720 even though the pressure in the base chamber 380 becomes greater than the pressure in the head chamber 400 at the beginning of retracting(rightward) movement of the drive piston 340 of the second drive cylinder 140.

A piston retraction sensor 740 and a piston extension sensor 760 are placed respectively at the head portion and the base portion of the cylinder housing 300 of the second drive cylinder 140. The retraction sensor 740 is adapted to issue a piston retraction signal as the drive piston 340 moves past the retraction sensor 740 at the end of retracting movement thereof. Similarly, the extension sensor 760 serves to generate a piston extension signal as the drive piston 340 moves past the extension sensor 760 at the end of extending movement. The piston retraction signal and the piston extension signal so produced are fed to a pump controller 780 which in turn will change the direction of rotation of the oil pump 100 each time one of the piston retraction and extension signals are received. This enables the drive piston 200 of the first drive cylinder 120 and the drive piston 340 of the second drive cylinder 140 to move in the reverse direction, causing alternate reciprocating movement of the pumping pistons 520, 580 of the first and second pump cylinders 460, 480. Unlike the embodiment illustrated in FIG. 4, it would be possible to attach the sensors 740, 760 to the cylinder housing 160 of the first drive cylinder 120 instead of the second drive cylinder 140.

Figure 5:
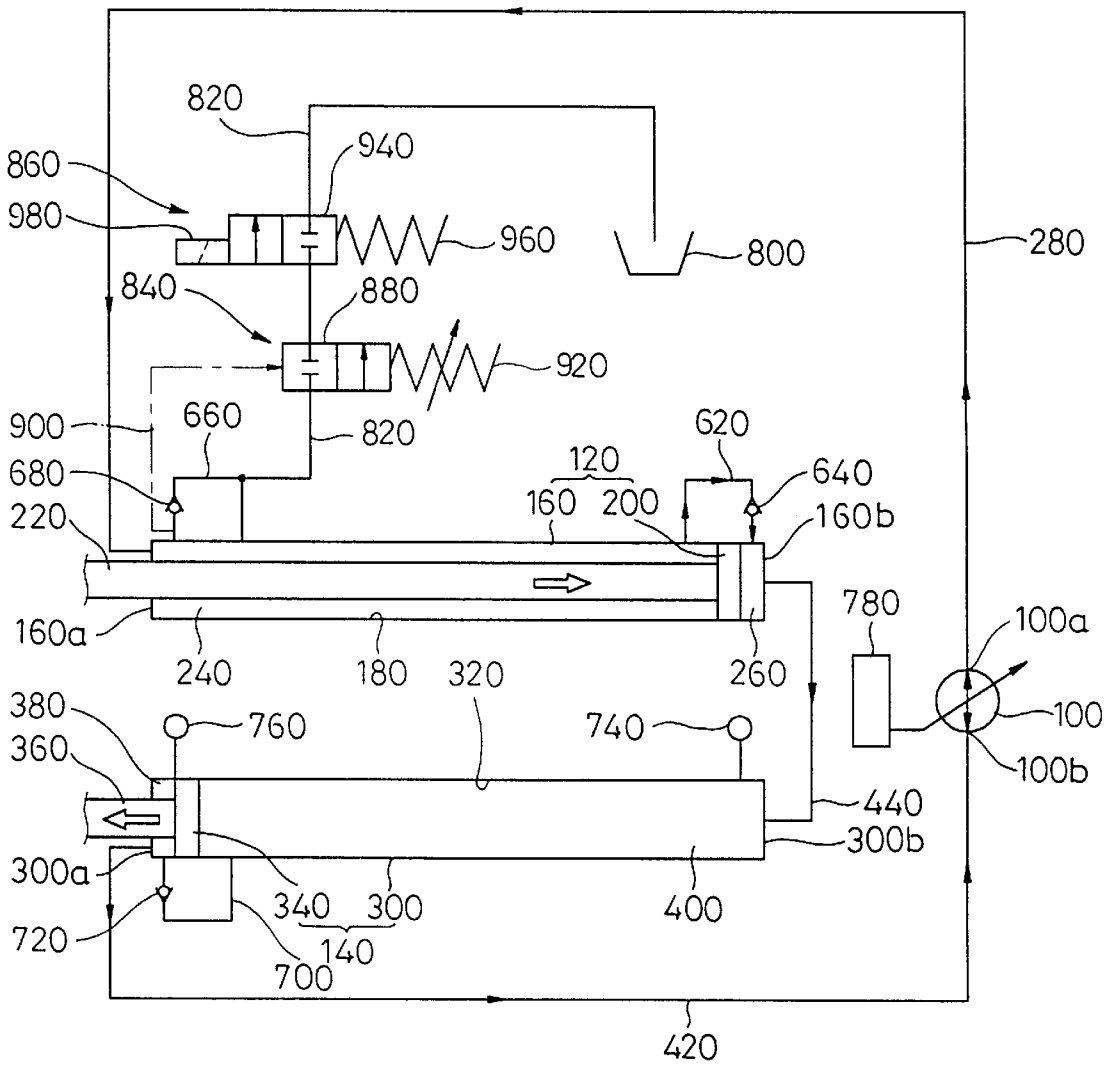
FIG. 5 is a partially cut away view of the inventive concrete pump device wherein the drive piston of the first drive cylinder is at the end of retracting movement to thereby allow the oil in a base and wherein a cartridge valve and a solenoid valve are placed in their closed position.
Figure 6:
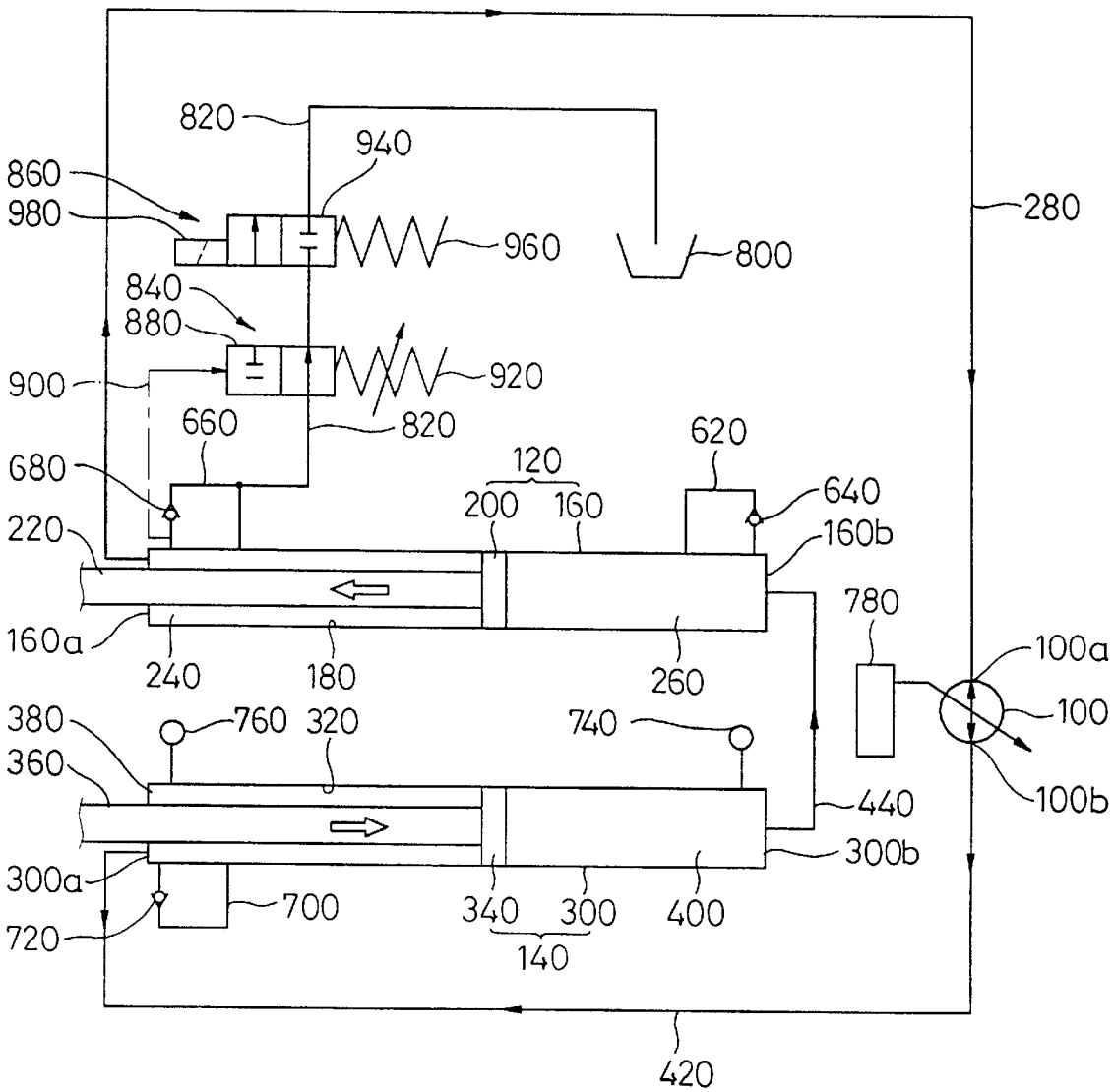
FIG. 6 is a view similar to FIG. 5 but illustrating the concrete pump device wherein the drive piston of the first drive cylinder is at the middle of extending movement and wherein the cartridge valve is shifted into an open position with the solenoid valve remaining in the closed position.
Figure 7:
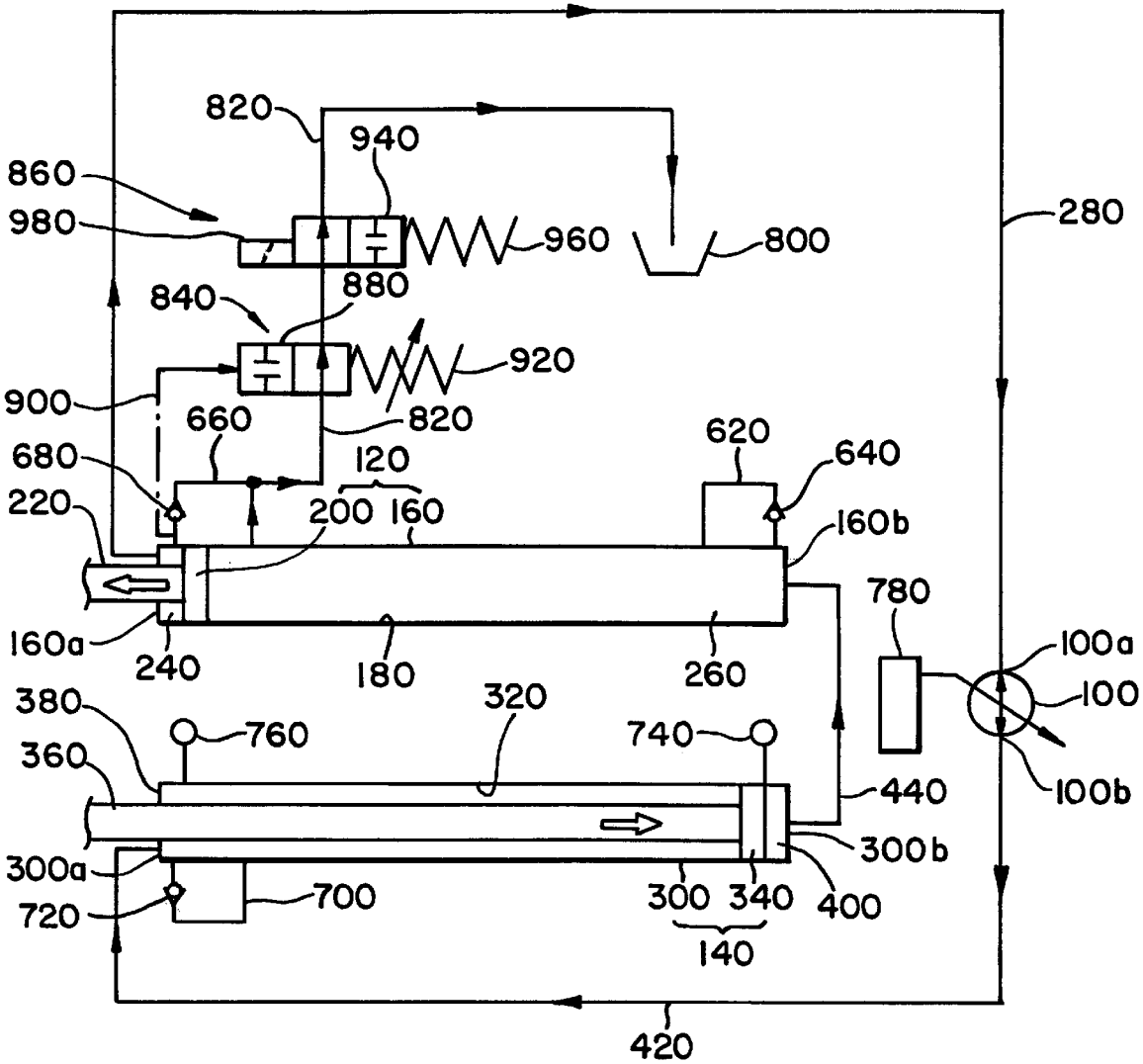
FIG. 7 is a view similar to FIG. 6 but showing the concrete pump device wherein the drive piston of the first drive cylinder is at the end of extending movement and wherein the cartridge valve and the solenoid valve are all shifted into the open position to permit a part of the oil in the head chamber to be drained to an oil tank.

One of the key features of the invention is that the bore 180 of the cylinder housing 160 of the first drive cylinder 120 leads to an oil tank 800 through a drain line 820. Provided along the drain line 820 are a cartridge valve 840 and a solenoid valve 860 which serve to control the timing and the amount of oil drainage from the head chamber 260 into the oil tank 800 through the drain line 820. The cartridge valve 840 has a spool 880 which can be shifted between a closed position as shown in FIGS. 4 and 5 and an open position as depicted in FIGS. 6 and 7. The spool 880 of the cartridge valve 840 is pushed into the closed position if the oil pressure applied to one side thereof through a pilot line 900 is great enough to overwhelm the resilient biasing force exerting on the other side thereof by an adjustable spring 920. The resilient biasing force of the adjustable spring 920 is selected such that, whenever the oil pressure in the base chamber 240 and hence in the pilot line 900 drops to below a predetermined reference pressure. e.g., the discharge pressure of the oil pump 100, the adjustable spring 920 can push the spool 880 of the cartridge valve 840 into the open position.

The solenoid valve 860 has a spool 940 that can be shifted between a closed position as illustrated in FIGS. 4, 5 and 6 and an open position as shown in FIG. 7 only. The spool 940 of the solenoid valve 860 is normally urged into the closed position by a spring 960 but will be shifted toward the open position against the biasing force of the spring 960 when a solenoid 980 is energized. Energization of the solenoid 980 is controlled by means of the pump controller 780 which receives piston retraction and extension signals from the piston sensors 740, 760. The pump controller 780 is designed to energize the solenoid 980 of the solenoid valve 860 only when the piston retraction signal is received from the piston sensor 740 while the concrete pump device is operated under a load-free, idle condition.

In a load-free, idle operation of the concrete pump device as constructed above, if the oil pump 100 feeds pressurized oil through the first fluid line 280 as shown in FIG. 4, the drive piston 200 of the first drive cylinder 120 will be retracted together with the pumping piston 520 and, at the same time, the drive piston 340 of the second drive cylinder 140 will be extended together with the pumping piston 580. During the course of such an idle operation, the oil pressure will be greatest(e.g., 45 bar) in the base chamber 240, medium level(e.g., 35 bar) in the base chamber 380 and lowest(e.g., 26 bar) in head chambers 260, 400. Thus the oil in the base chamber 240 will be admitted into the head chamber 260 through the head bypass line 62 at the end of the retracting movement of the drive piston 200 as illustrated in FIG. 5, to thereby suppress further retracting movement thereof. During the retracting movement of the drive piston 200, the spool 880 of the cartridge valve 840 is pushed into the closed position by the pilot pressure in the pilot line 900, because the oil pressure in the base chamber 240 is as great as the predetermined reference pressure, namely, the discharge pressure of the oil pump 100. Also, the spool 940 of the solenoid valve 860 continues to be in the closed position due to the fact that the pump controller 780 will receive no signal from the piston sensor 740 and therefore keep deenergized the solenoid 980 of the solenoid valve 860. This prevents oil drainage through the drain line 820 into the oil tank 800.

In the event that the oil pump 100 is rotated in the reverse direction to feed pressurized oil through the second fluid line 420 to cause retracting movement of the drive piston 340 and extending movement of the drive piston 200 as shown in FIGS. 6 and 7, the oil pressure will be greatest in the base chamber 380, medium level in the base chamber 240 and smallest in the head chambers 400, 260. Since the oil pressure in the base chamber 240 is higher than that in the head chamber 260, the oil in the head chamber 260 cannot be admitted into the base chamber 240 through the base bypass line 660 even at the end of extending movement of the drive piston 200. The oil pressure in the base chamber 240 and in the pilot line 900 is, however, smaller than the predetermined reference pressure at this time, which means that the cartridge valve spool 880 is shifted into the open position by the biasing force of the spring 920, as depicted in FIGS. 6 and 7.

In the meantime, the piston sensor 740 will issue a piston retaction signal when the drive piston 340 is at the end of retracting movement with the drive piston 200 being at the end of extending movement. Responsive to the piston retraction signal, the pump controller 780 enables the solenoid 980 of the solenoid valve 860 to be temporally energized, thus bringing the spool 940 into the open position as shown in FIG. 7. Accordingly, the pressurized oil in the head chamber 260 will be drained through the drain line 820 into the oil tank 800 until and unless the solenoid 980 is deenergized. The energization time of the solenoid 980 is controlled such that substantially the same amount of the oil introduced into the head chamber 260 at the end of retracting movement can be drained through the drain line 820 at the end of extending movement of the drive piston 200. Such positive drainage of the pressurized oil through the drain line 820 during the load-free, idle operation of the concrete pump device helps avoid any unwanted accumulation of oil in the head chamber 260 and resultant shift of stroke of the drive piston 200, which would otherwise cause crash of the piston 200 against the base cover 160*a* of the cylinder housing 160.

While the invention has been shown and described with reference to a preferred embodiment, it should be apparent to those skilled in the art that many changes and modifications may be made without departing from the scope of the invention as defined in the claims.

What is claimed is:

1. A bulk material pump device, comprising;

an oil tank;

an oil pump for producing pressurized oil;

first and second hydraulic cylinders each having a cylinder housing with an axial bore and a drive piston with a piston rod, the drive piston of the respective drive cylinder slidably received in the axial bore to divide it into a base chamber and a head chamber, the base chamber of the second drive cylinder coupled to the oil pump via a second fluid line, the head chamber of the first drive cylinder being in fluid communication with the head chamber of the second drive cylinder;

first and second pump cylinders each having a pumping barrel and a pumping piston slidably received in the pumping barrel, the pumping piston of the first pump cylinder affixed to the piston rod of the first drive cylinder for unitary movement therewith, the pumping piston of the second pump cylinder attached to the piston rod of the second drive cylinder for unitary movement therewith;

a head bypass line for allowing the pressurized oil in the base chamber of the first drive cylinder to be admitted into the head chamber thereof at the end of retracting movement of the drive piston of the first drive cylinder;

a base bypass line for allowing the pressurized oil in the head chamber of the first drive cylinder to be admitted into the base chamber thereof only at the end of extending movement of the drive piston of the first drive cylinder; and a cartridge valve operatively connected to the base bypass line via a pilot line in such a manner that the cartridge valve can be closed or opened by the fluid pressure developed in the base chamber of the first drive cylinder.

2. The bulk material pump device as recited in claim 1, wherein said cartridge valve is adapted to prevent the oil in the head chamber of the first drive cylinder from drainage in the event that the oil pressure in the base chamber of the first drive cylinder is greater than a predetermined reference pressure.

3. The bulk material pump device as recited in claim 2, further comprising a drain line for interconnecting the head chamber of the first drive cylinder and the oil tank at the end of extending movement of the drive piston of the first drive cylinder.

4. The bulk material pump device as recited in claim 3, further comprising a solenoid valve provided on the drain line and having a spool shiftable between a closed position and an open position, the spool of the solenoid valve normally biased into the closed position to block the drain line and shiftable into the open position when the solenoid valve is energized, to permit oil drainage therethrough.

5. The bulk material pump device as recited in claim 4, further comprising a first piston sensor provided on the cylinder housing of the second drive cylinder for generating a piston retraction signal when the drive piston of the second drive cylinder is at the end of retracting movement, a second piston sensor for issuing a piston extension signal when the drive piston of the second drive cylinder is at the end of extending movement, and a controller for reversing the direction of rotation of the oil pump each time one of the piston retraction and extension signals is generated by the first and second piston sensors and for energizing the solenoid valve when the piston retraction signal is received from the first piston sensor.

* * * * *